US011391125B2

(12) United States Patent
Al-Ghamdi

(10) Patent No.: US 11,391,125 B2
(45) Date of Patent: Jul. 19, 2022

(54) METHOD AND SYSTEM OF SELF-CONTAINED REPLACEABLE FILTRATION SCREEN WITH HIGH PERFORMANCE FOR OIL AND GAS WELLS

(71) Applicant: SAUDI ARABIAN OIL COMPANY, Dhahran (SA)

(72) Inventor: Ahmed Saeed Al-Ghamdi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/998,604

(22) Filed: Aug. 20, 2020

(65) Prior Publication Data

US 2022/0056788 A1 Feb. 24, 2022

(51) Int. Cl.

| | |
|---|---|
| ***E21B 43/10*** | (2006.01) |
| ***E21B 43/04*** | (2006.01) |
| ***E21B 43/08*** | (2006.01) |

(52) U.S. Cl.

CPC ..... *E21B 43/10* (2013.01); *E21B 43/04* (2013.01); *E21B 43/082* (2013.01); *E21B 43/086* (2013.01)

(58) Field of Classification Search

CPC ..... E21B 43/10; E21B 43/082; E21B 43/04; E21B 43/086; E21B 43/08; E21B 33/04; E21B 33/0422

See application file for complete search history.

(56) References Cited

U.S. PATENT DOCUMENTS

| | | | | |
|---|---|---|---|---|
| 2,143,072 A * | 1/1939 | Johnson | E21B 43/086 166/231 |
| 2,336,168 A * | 12/1943 | Eckel | E21B 43/04 166/246 |
| 2,796,939 A | 6/1957 | Woodruff | |
| 2,877,852 A * | 3/1959 | Bashara | E21B 43/08 166/236 |
| 4,537,254 A | 8/1985 | Elson et al. | |

(Continued)

FOREIGN PATENT DOCUMENTS

| | | |
|---|---|---|
| CA | 1246438 A | 12/1988 |
| CA | 2122106 C | 6/1998 |

(Continued)

OTHER PUBLICATIONS

International Search Report and Written Opinion of the International Searching Authority issued in corresponding International Application No. PCT/US2020/055974, dated May 11, 2021 (13 pages).

(Continued)

*Primary Examiner* — Michael R Wills, III

(74) *Attorney, Agent, or Firm* — Osha Bergman Watanabe & Burton LLP

(57) ABSTRACT

A system for a well completions operation includes a packed filtration screen assembly removably attached around a perforated portion of a liner, where the packed filtration screen assembly has an inner slotted basket, an outer slotted basket positioned concentrically around the inner slotted basket, and gravel held in an annular space between the inner slotted basket and the outer slotted basket and axial end caps located at opposite axial ends of the annular space.

19 Claims, 7 Drawing Sheets

(56) References Cited

U.S. PATENT DOCUMENTS

| | | | | |
|---|---|---|---|---|
| 4,583,594 | A * | 4/1986 | Kojicic | B01D 24/08 166/228 |
| 4,811,790 | A | 3/1989 | Jennings, Jr. et al. | |
| 5,004,049 | A | 4/1991 | Arterbury | |
| 5,083,614 | A | 1/1992 | Branch | |
| 5,150,753 | A | 9/1992 | Gaidry et al. | |
| 5,279,362 | A | 1/1994 | Pool | |
| 5,500,174 | A * | 3/1996 | Scott | B01D 29/111 264/112 |
| 5,551,513 | A | 9/1996 | Surles et al. | |
| 6,416,661 | B1 * | 7/2002 | Cordry | B01D 24/08 166/228 |
| 2006/0260795 | A1 * | 11/2006 | Rescia | E21B 33/128 166/51 |
| 2012/0067575 | A1 * | 3/2012 | Luyster | C09K 8/36 166/278 |
| 2014/0231083 | A1 * | 8/2014 | Yeh | E21B 43/14 166/278 |
| 2017/0241235 | A1 * | 8/2017 | Castro | E21B 43/25 |
| 2020/0003019 | A1 * | 1/2020 | Ali | E21B 23/02 |

FOREIGN PATENT DOCUMENTS

| | | | |
|---|---|---|---|
| CN | 202731859 | U | 2/2013 |
| CN | 107882537 | A | 4/2018 |
| EP | 0547865 | B1 | 10/1997 |
| EP | 1160417 | A2 | 12/2001 |
| EP | 2383431 | A2 | 11/2011 |
| WO | 2003014521 | A1 | 2/2003 |
| WO | 2018191783 | A1 | 10/2018 |

OTHER PUBLICATIONS

"Slotted liner and wire wrapped screens", PetroWiki, last edit Jun. 29, 2015, URL: <https://petrowiki.org/index.php?title=Slotted_liners_and_wire_wrapped_screens&oldid=48231> (9 pages).

"WeldSlot PP: Slip-on wire-wrapped prepacked screen", Product Sheet, 14-SM-0027, Schlumberger, Access Jun. 6, 2020, 2014, URL: <https://www.slb.com/-/media/files/sand-control/product-sheet/weldslot-pp-ps.ashx> (2 pages).

* cited by examiner

METHOD AND SYSTEM OF SELF-CONTAINED REPLACEABLE FILTRATION SCREEN WITH HIGH PERFORMANCE FOR OIL AND GAS WELLS

BACKGROUND

When drilling a well, the well may travel through different types of poorly consolidated formations. Such formations may include, for example, high permeability formations containing sand and/or other fine solids. When drilling through poorly consolidated formations, the industry conventionally uses a gravel packing technique that involves pumping gravel downhole and around a perforated liner to create a gravel filter between the borehole wall and the perforated liner.

FIGS. 1-3 show an example of a conventional gravel packing process in a poorly consolidated section 11 of a well 10, such as a sand formation. In FIG. 1, a perforated and/or screened liner 12 and liner hanger 13 is sent downhole using a liner hanger setting tool 14 to the poorly consolidated section 11 of the well 10. In FIG. 2, the liner hanger 13 is set at the end of a casing 15 lining a portion of the well 10. Setting the liner hanger 13 may include radially expanding one or more slips 16 or packing elements on the liner hanger 13 to contact the inner surface of the casing 15. Once set, gravel 16 is pumped downhole out of gravel ports 18 through the liner 12 to fill the annulus 17 between the borehole wall and the liner 12. Water or other fluid may be mixed with the gravel 16 to aid in pumping the gravel 16 around the exterior of the liner 16. In FIG. 3, once gravel packing is complete, the well 10 is ready for sand-free production.

Conventional gravel packing processes may incur issues with pressure while pumping, which may result in not enough gravel being packed between the wellbore and liner and/or increased completion time. Further, when drilling horizontal or directional sections of a well through poorly consolidated formations, gravel may be unevenly distributed around the liner.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to methods for completing a well that include packing gravel in an annular space between an inner slotted basket and an outer slotted basket to form a packed filtration screen assembly, attaching the packed filtration screen assembly around a perforated portion of a liner, sending the liner and attached packed filtration screen assembly into the well, and hanging the liner from an end of a casing lining the well to position the packed filtration screen assembly in an open hole portion of the well below the end of the casing.

In another aspect, embodiments of the present disclosure relate to systems for completing a well that include a packed filtration screen assembly having an inner slotted basket, an outer slotted basket positioned concentrically around the inner slotted basket, gravel held in an annular space between the inner slotted basket and the outer slotted basket, and axial end caps located at opposite axial ends of the annular space, wherein the packed filtration screen assembly may be removably attached to around a perforated portion of a liner.

Other aspects and advantages will be apparent from the following description and the appended claims.

BRIEF DESCRIPTION OF DRAWINGS

Wherever possible, like or identical reference numerals are used in the figures to identify common or the same elements. The figures are not necessarily to scale and certain features and certain views of the figures may be shown exaggerated in scale for purposes of clarification.

DETAILED DESCRIPTION

As used herein, the term "coupled" or "coupled to" or "connected" or "connected to" may indicate establishing either a direct or indirect connection, and is not limited to either unless expressly referenced as such. Further, the terms "lower," "below," "bottom," and the like may be used to describe a position or tool component that, when in a downhole location, is relatively farther away from the surface of the well, while the terms "upper," "top," "above," and the like may be used to describe a position or tool component that, when in a downhole location, is relatively closer to the surface of the well.

Embodiments disclosed herein include methods and systems using a self-contained replaceable filtration screen assembly. The filtration screen assembly may be packed with gravel or other filtration medium prior to its use downhole. The packed filtration screen assembly may then be connected around a downhole tubular, such as a liner, and sent downhole for use in production of the well.

According to embodiments of the present disclosure, a filtration screen assembly may include an inner slotted basket, an outer slotted basket positioned concentrically around the inner slotted basket, and one or more connecting walls connecting the inner slotted basket and the outer slotted basket together while also providing an annular space between the inner and outer slotted baskets. To pack the filtration screen assembly, gravel or other filtration medium may be poured into the annular space between the inner and outer slotted baskets. The annular space and filtration medium filling may be entirely enclosed between the inner and outer filtration baskets and connecting walls therebetween.

Figure 1:
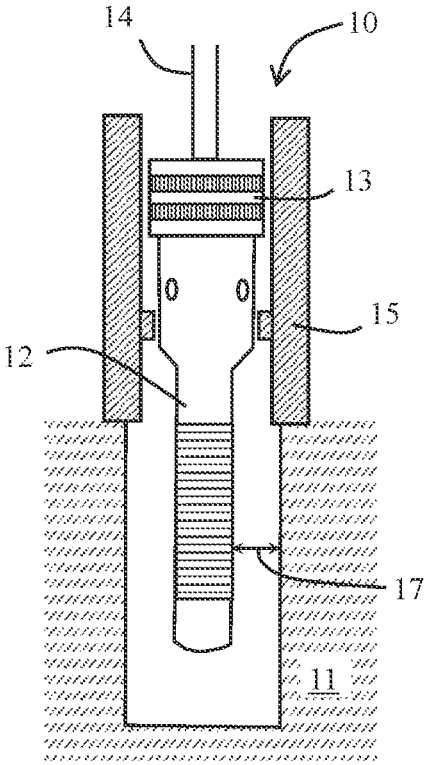
FIG. 1 (Prior Art)
FIGS. 1-3 show steps in a conventional gravel packing process.
Figure 2:
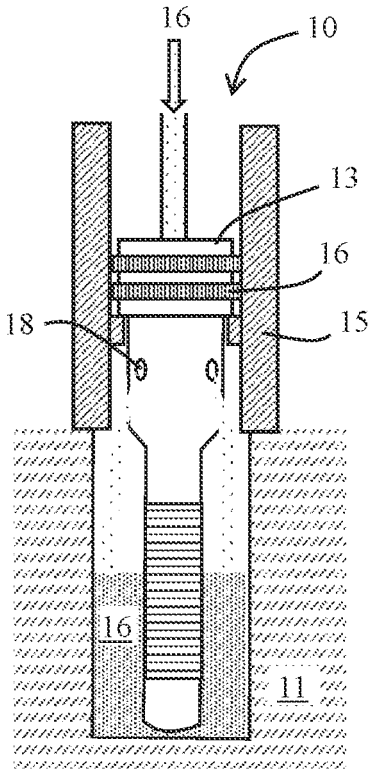
FIG. 2 (Prior Art)
Figure 3:
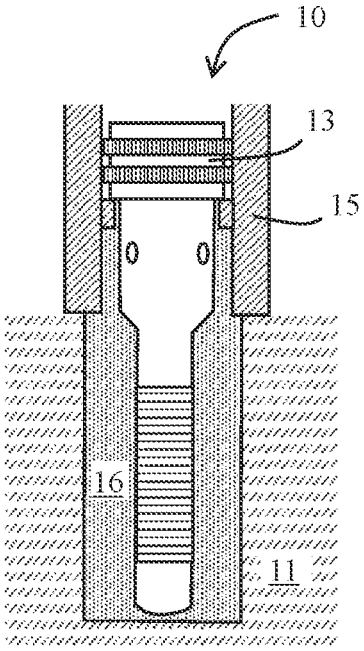
FIG. 3 (Prior Art)
Figure 4:
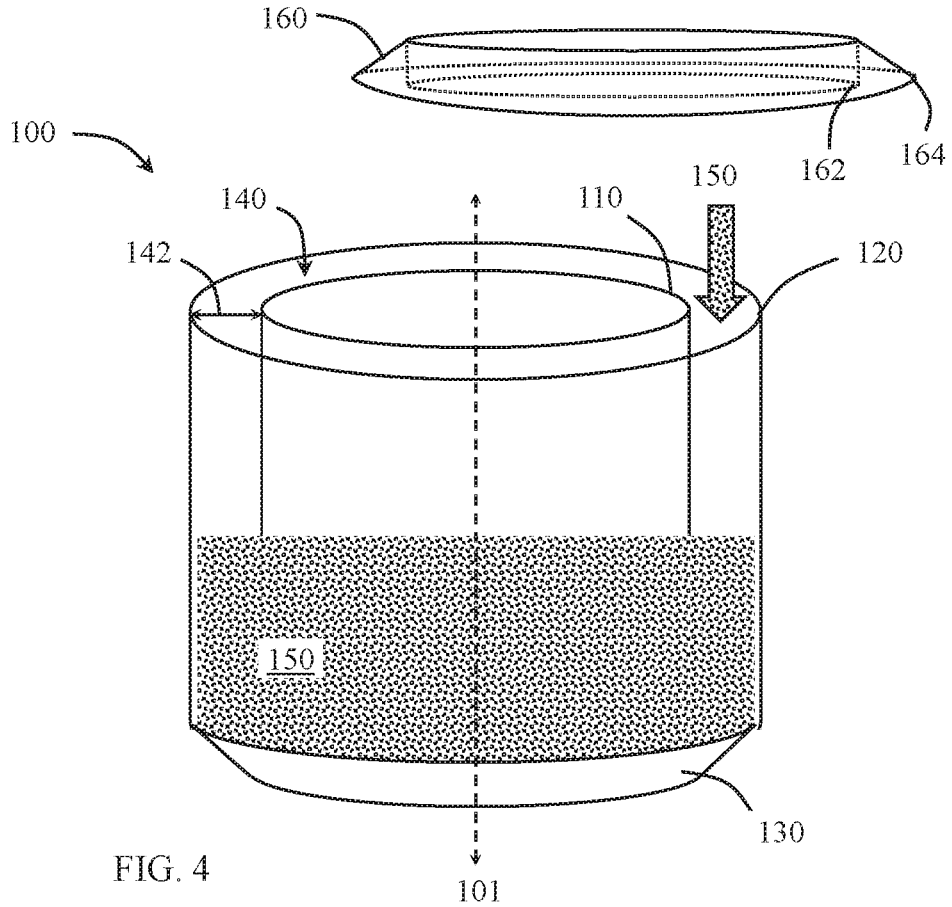
FIG. 4 shows a filtration screen assembly being packed with a filtration medium according to embodiments of the present disclosure.

For example, FIG. 4 shows a diagram of a filtration screen assembly 100 being assembled. The filtration screen assembly 100 may include an outer slotted basket 120 connected concentrically around an inner slotted basket 110 by a first axial end cap 130. The first axial end cap 130 may have a generally toroidal or elliptical ring shape. An outer perimeter of the first axial end cap 130 may be connected to the outer slotted basket 120, and an inner perimeter of the first axial end cap 130 may be connected to the inner slotted basket 110, for example, by welding or other connection methods. For example, in some embodiments, the inner perimeter of the first axial end cap 130 may be connected to the inner slotted basket 110 using a threaded connection, and/or the outer perimeter of the first axial end cap 130 may be connected to the outer slotted basket 110 using a threaded connection. In some embodiments, a first axial end cap 130 may be integrally formed with the inner slotted basket 110 or the outer slotted basket 120 and connected to the other of the inner or outer slotted basket 110, 120.

Figure 5:
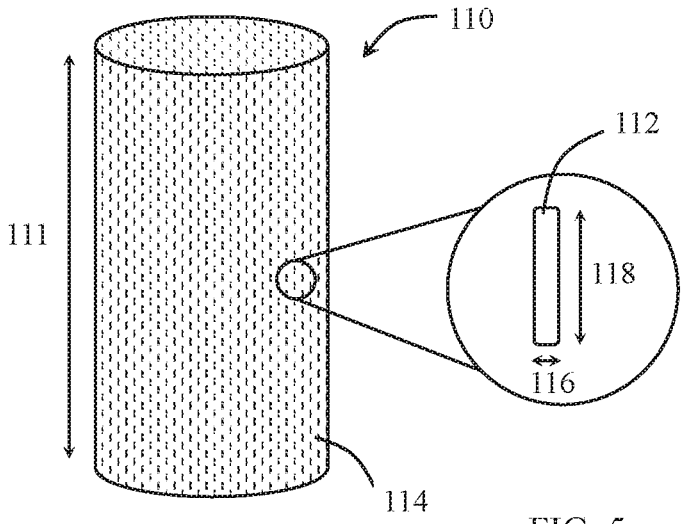
FIG. 5 shows a zoomed view of a slotted basket according to embodiments of the present disclosure.

The inner and outer slotted baskets 110, 120 may have a woven, wire wrapped, or slotted pattern of openings formed through the wall of each of the inner and outer slotted baskets 110, 120. For example, FIG. 5 shows a perspective view of the inner slotted basket 110, having a plurality of slots 112 formed through the wall 114 of the basket 110. The slots 112 may be arranged in a pattern or randomly along the axial length 111 of the inner slotted basket 110, as measured between the axial ends of the basket 110. The slots 112 may be formed, for example, by cutting openings through the wall 114 of the basket 110 using an ultra-thin cutting tool or a laser. The slots 112 may have an opening width 116 and extend an opening length 118 that is greater than or equal to the opening width 116. Slot opening widths 116 may be less than the size of the gravel or other filtration medium 150 packed in the filtration screen assembly 100, and may range in size, for example, from less than 0.5 inches, less than 0.2 inches, or less than 0.05 inches. In some embodiments having slots 112 extending longitudinally along the axial length 111 of the basket, the opening length 118 of the slots 112 may extend less than half, less than a fourth, less than a tenth, or less than a hundredth of the axial length 111 of the basket 110. In some embodiments, slots 112 may extend an opening length 118 around the entire or a partial circumference of the basket 110.

Slots 112 formed in the inner slotted basket 110 may have the same sized or differently sized opening widths as slots formed in the outer slotted basket 120. Further, slots 112 formed in the inner slotted basket 110 may be oriented the same or differently than slots formed in the outer slotted basket 120. For example, an inner slotted basket 110 may have longitudinally extending slots 112 formed therein, and an outer slotted basket 120 may have circumferentially extending slots formed therein, or vice versa.

In some embodiments, slots or other openings may be formed through the inner and/or outer slotted baskets 110, 120 that have an opening width that is less than a perforation opening size formed through a perforated liner on which the filtration screen assembly is to be connected.

The inner and outer slotted baskets 110, 120 may be concentrically aligned such that the longitudinal axes 101 of the inner and outer slotted baskets 110, 120 are co-axially aligned, and an annular space 140 between the inner and outer slotted baskets 110, 120 has a uniform thickness 142 (as measured radially between the inner and outer slotted baskets) around the entire annular space 140. The thickness 142 of the annular space 140 may vary, for example, depending on the type and size of the filtration medium, the size of the tubular around which the filtration screen assembly 100 will be connected around, and the size of the well in which the filtration screen assembly 100 will be used. For example, an annular space 140 may have a thickness ranging from a lower limit selected from 0.5 inches, 0.8 inches, 1 inch, and 1.5 inches to an upper limit selected from 1.5 inches, 2 inches, 3 inches, and 4 inches, where any upper limit may be used in combination with any lower limit. In embodiments using a relatively finer filtration medium, the annular space 140 may be designed to have a relatively smaller thickness 142 than when using a relatively coarser filtration medium.

A filtration medium 150 may be poured into the annular space 140 defined between the inner and outer slotted baskets 110, 120 and the first axial end cap 130. The filtration medium 150 may be, for example, gravel, beads, or other granularized material. In some embodiments, the filtration medium may be gravel that ranges in size from 1 mm to 2.5 mm in diameter, as measured along its longest dimension. The gravel may have a unimodal, bimodal, or multimodal size distribution. In some embodiments, gravel may be provided as having a narrow range in size, for example, where the standard deviation in size ranges from less than 10 percent, less than 5 percent, or less than 2 percent from the average size of the gravel.

The filtration medium 150 may be poured into the filtration screen assembly 100 offsite (e.g., at a factory or other location away from a well site) or onsite near a well. After filling the annular space entirely with the filtration medium 150, a second axial end cap 160 may be connected at an opposite axial end of the inner and outer slotted baskets 110, 120 from the first axial end cap 130 in order to seal and contain the filtration medium 150 inside the annular space 140. The second axial end cap 160 may have the same or different shape as the first axial end cap 160 and may have a generally toroidal or elliptical ring shape. The second axial end cap 160 may be connected to the inner and outer slotted baskets 110, 120, for example, by welding, a threaded connection, or other latching mechanism. In some embodiments, one of an inner perimeter 162 and an outer perimeter 164 of the second axial end cap 160 may be threaded to the inner or outer slotted basket 110, 120, respectively, where such connection may axially compress the second axial end cap 160 toward the first axial end cap 130.

When gravel or other filtration medium 150 is contained within and fully fills the entire annular space 140 between the inner and outer slotted baskets 110, 120 and the first and second axial end caps 130, 160, the filtration screen assembly 100 may be referred to as a packed filtration screen assembly 100. The packed filtration screen assembly 100 may be removably attached to a downhole tubular such as a liner, for example, using connection clamps.

Figures 6, 7:
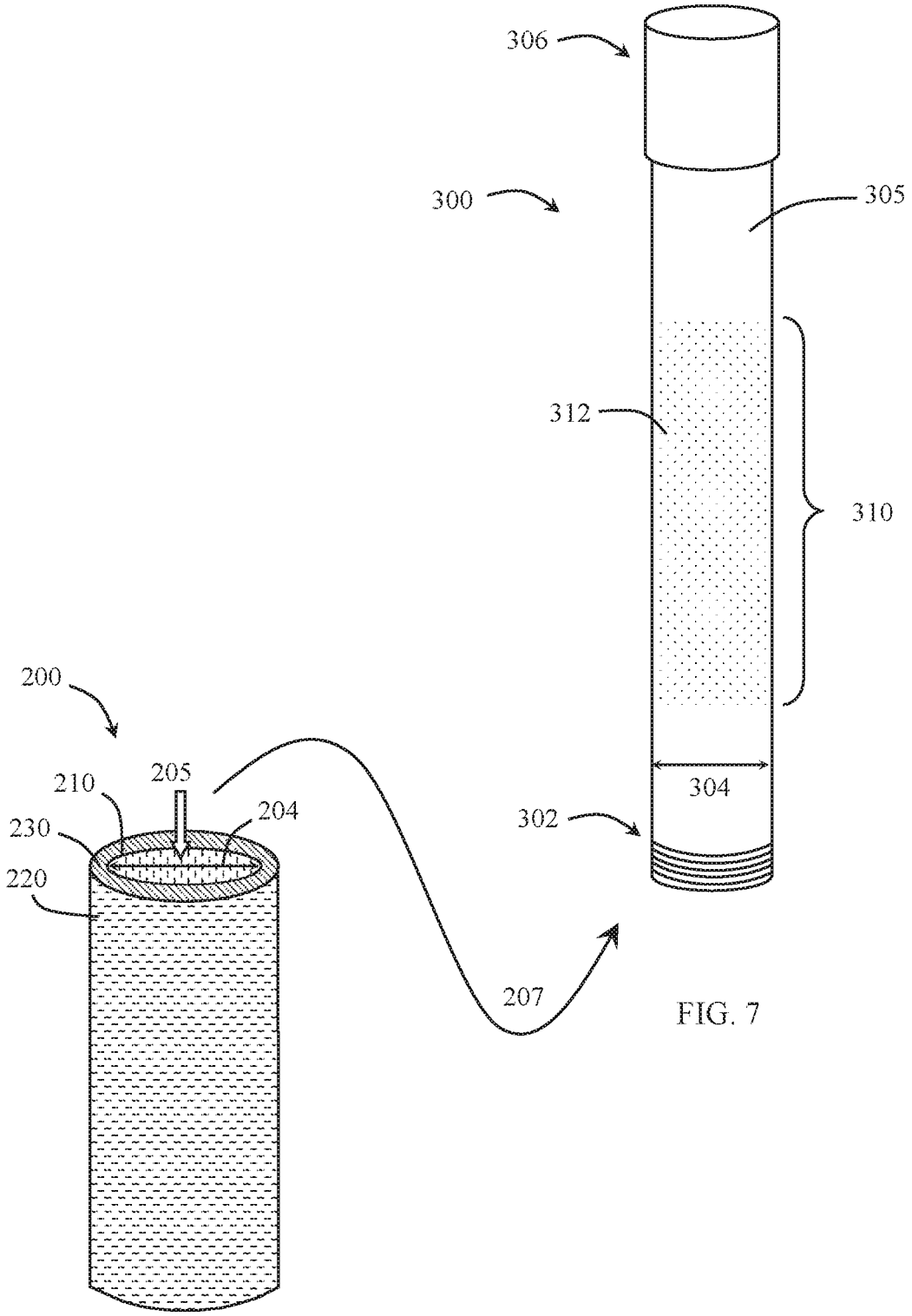
FIG. 6 shows a perspective view of a packed filtration screen assembly according to embodiments of the present disclosure.
FIG. 7 shows an example of a perforated liner around which a packed filtration screen assembly may be attached according to embodiments of the present disclosure.
Figure 8:
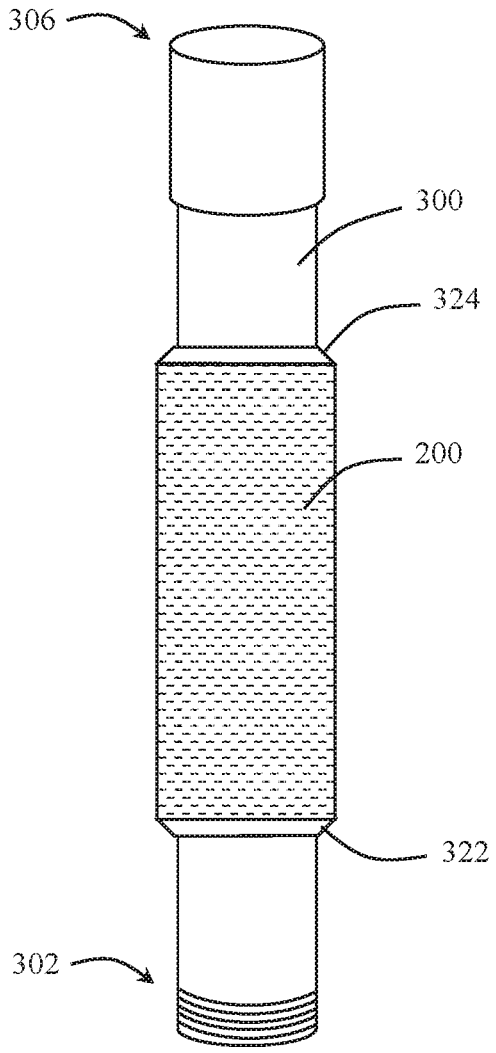
FIG. 8 shows a packed filtration screen assembly attached to a perforated liner according to embodiments of the present disclosure.

FIGS. 6-8 show an example of steps for connecting a packed filtration screen assembly 200 to a perforated liner 300. The packed filtration screen assembly 200 may include an inner slotted basket 210, an outer slotted basket 220, and connecting walls 230 connecting the axial ends of the inner and outer slotted baskets 210, 220, where gravel is packed and contained within the annular space defined between the inner and outer slotted baskets 210, 220 and connecting walls 230. The inner slotted basket 210 may define a conduit or through hole 205 extending axially through the length of the packed filtration screen assembly 200.

The perforated portion 310 of the liner 300 may have perforation openings 312 with a size greater than the openings formed through the inner and outer slotted baskets 210, 220. The openings formed through the inner and outer slotted baskets 210, 220 may be smaller than the size of the gravel packed in the packed filtration screen assembly 200, such that the gravel may not escape through the openings in the inner and outer slotted baskets 210, 220.

According to some embodiments of the present disclosure, the packed filtration screen assembly 200 may be connected to a perforated liner 300 by sliding the packed filtration screen assembly 200 around an axial end 302 of the perforated liner 300, as represented by arrow 207. In such embodiments, the through hole 205 of the packed filtration screen assembly 200 may have an inner diameter 204 that is slightly greater than the outer diameter 304 of the axial end 302 of the perforated liner 300, such that the packed filtration screen assembly 200 may tightly slide around the perforated liner 300 (e.g., where a clearance between the inner diameter 204 of the packed filtration screen assembly 200 and the outer diameter 304 of the perforated liner 300 may be less than 1 inch, less than 0.5 inches, or less than 0.2 inches).

The packed filtration screen assembly 200 may be slid axially along the perforated liner 300 to surround a perforated portion 310 of the perforated liner 300. In the embodiment shown, the perforated liner 300 may have a tubular body 305 having an outer diameter 304 that is substantially uniform along its length from the axial end 302 to throughout the perforated portion 310, such that the packed filtration screen assembly 200 may fit around both the axial end 302 and the perforated portion 310 of the liner 300. In some embodiments, the axial end 302 of the liner 300 may have an outer diameter that is less than the outer diameter 304 of the perforated portion 310 of the liner 300, for example, to allow for a connection to be made to the axial end 302 of the liner 300 after assembling the packed filtration screen assembly 200 to the liner 300. In such embodiments, both the outer diameter 304 of the perforated portion 310 and the outer diameter of the axial end 302 of the liner 300 are smaller than the inner diameter 204 of the packed filtration screen assembly 200.

As shown in FIG. 8, once the packed filtration screen assembly 200 is slid onto the liner 300 and in a position entirely surrounding the perforated portion 310 of the liner 300, a lower clamp 322 may be attached around the liner 300 at a lower axial end of the packed filtration screen assembly 200, and an upper clamp 324 may be attached around the liner 300 at an upper axial end of the packed filtration screen assembly 200. The lower and upper clamps 322, 324 may be friction-fitted at the lower and upper axial ends, respectively, of the packed filtration screen assembly 200 to hold the packed filtration screen assembly 200 in place. In some embodiments, the lower and upper axial ends of the packed filtration screen assembly 200 may be welded to the liner 300 to hold the packed filtration screen assembly 200 in place. Other methods of attaching the packed filtration screen assembly 200 to the liner 300 may be used to hold the packed filtration screen assembly 200 around the perforated portion 310 of the liner 300.

After the packed filtration screen assembly 200 is attached to the liner 300, additional components may be attached to one or both axial ends of the liner 300 to send downhole for a production operation. For example, a sand trap, bull plug, or an additional liner pipe may be connected to the axial end 302 of the liner 300 below the packed filtration screen assembly 200, and a liner hanger or an additional liner pipe may be connected to an opposite axial end 306 of the liner 300. The axial ends 302, 306 of the liner 300 may be threaded connections, for example, a pin end and a box end, or may have other connection features known in the art for tubular connections.

In some embodiments, a packed filtration screen assembly may be packed in circumferential sections, which once packed, may be assembled and attached around a perforation portion of a tubular. The circumferential sections may be fully self-contained and individually packed prior to assembling around the perforated portion of the tubular. For example, gravel or other filtration medium may be fully enclosed within a space defined by an inner slotted basket circumferential section, an outer slotted basket circumferential section, and radial walls extending between and connecting the inner and outer slotted basket circumferential sections to form a packed circumferential section of a packed filtration screen assembly.

Two or more packed circumferential sections may be attached around a perforated portion of a tubular, such as a perforated liner, for example, by welding the packed circumferential sections together and to the tubular and/or by using one or more connection mechanisms such as a clamp or latch to connect the packed circumferential sections together and to the tubular.

Figure 9:
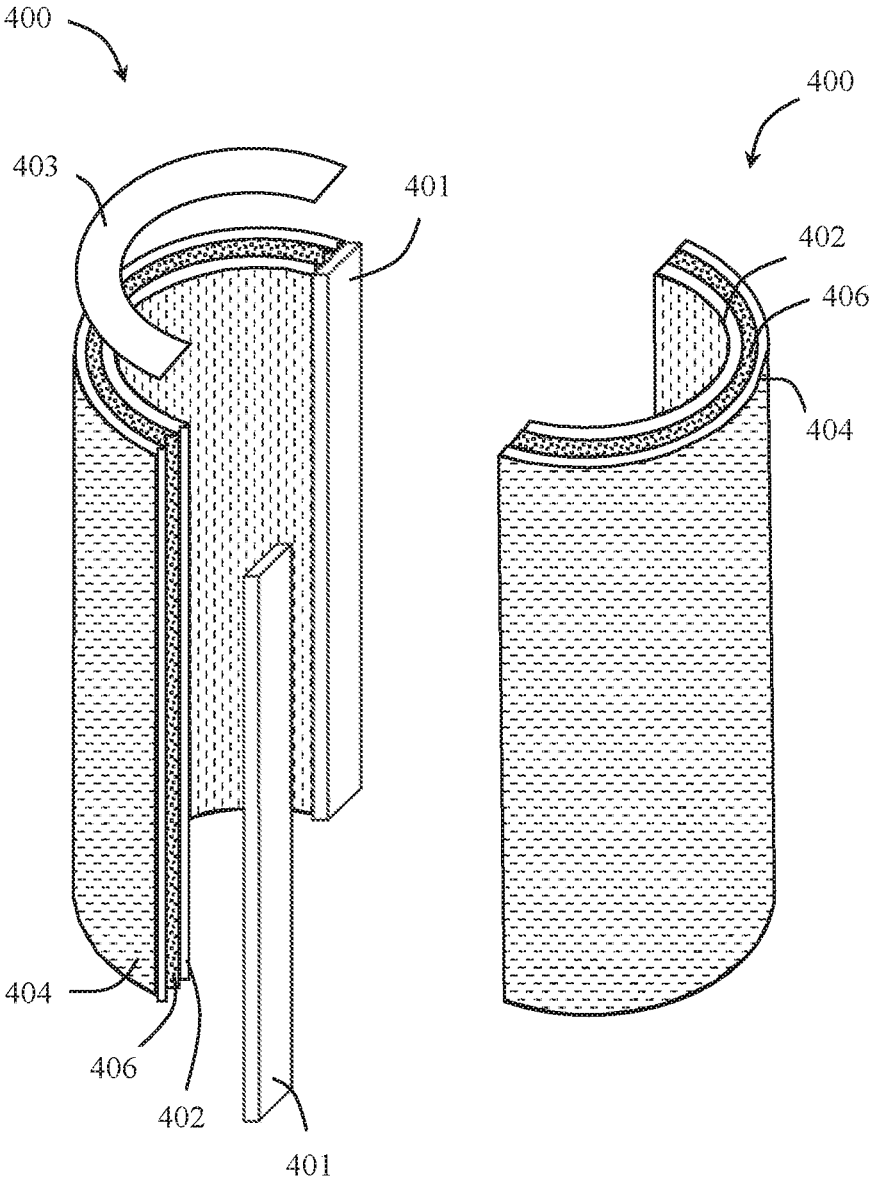
FIG. 9 shows a deconstructed view of packed circumferential sections of a packed filtration screen assembly according to embodiments of the present disclosure.

For example, FIG. 9 shows a deconstructed view of two packed circumferential sections 400 of a packed filtration screen assembly, where each packed circumferential section 400 may form a half of the packed filtration screen assembly when assembled. In other embodiments, more than two packed circumferential sections may form equi-portioned circumferential sections of a packed filtration screen assembly.

A packed circumferential section 400 may include an inner slotted basket circumferential section 402, an outer slotted basket circumferential section 404, and an annular space between the inner and outer slotted basket circumferential sections 402, 404. The annular space may have a uniform thickness along the entire circumferential section 400, where the annular space thickness is measured along a radial dimension between the inner and outer slotted basket circumferential sections 402, 404. The annular space may be filled with gravel 406 or other filtration medium. Radial walls 401 may be attached at the sides of the circumferential section 400, which may enclose the gravel 406 in the annular space along the sides of the circumferential section. The radial walls 401 may extend between the inner slotted basket circumferential section 402 and the outer slotted basket circumferential section 404, or may be attached to and cover the sides of the inner and outer slotted basket circumferential sections 402, 404 and the annular space therebetween. Further, axial end caps 403 may be attached at opposite axial ends of the annular space to enclose the gravel 406 in the annular space along the axial ends of the circumferential section 400.

Packed circumferential sections 400 may be assembled, for example, by providing multiple circumferential sections of an inner slotted basket 402 and an outer slotted basket 404, which are connected together using one or more connecting walls (e.g., radial walls 401 and axial end caps 403) to define an annular space in which gravel may be contained. Gravel 406 may be filled in the annular space in each of the multiple circumferential sections 400 and entirely enclosed with the connecting walls between the inner and outer slotted basket circumferential sections 402, 404. After each of the circumferential sections 400 are packed with gravel 406 and enclosed, the multiple packed circumferential sections 400 may be fitted together around a tubular to attach the packed filtration screen assembly to the tubular.

Slotted baskets and connecting walls forming packed filtration screen assemblies may be formed, for example, of a corrosion resistant material, such as stainless steel, aluminum alloys, and galvanized steel.

Figure 10:
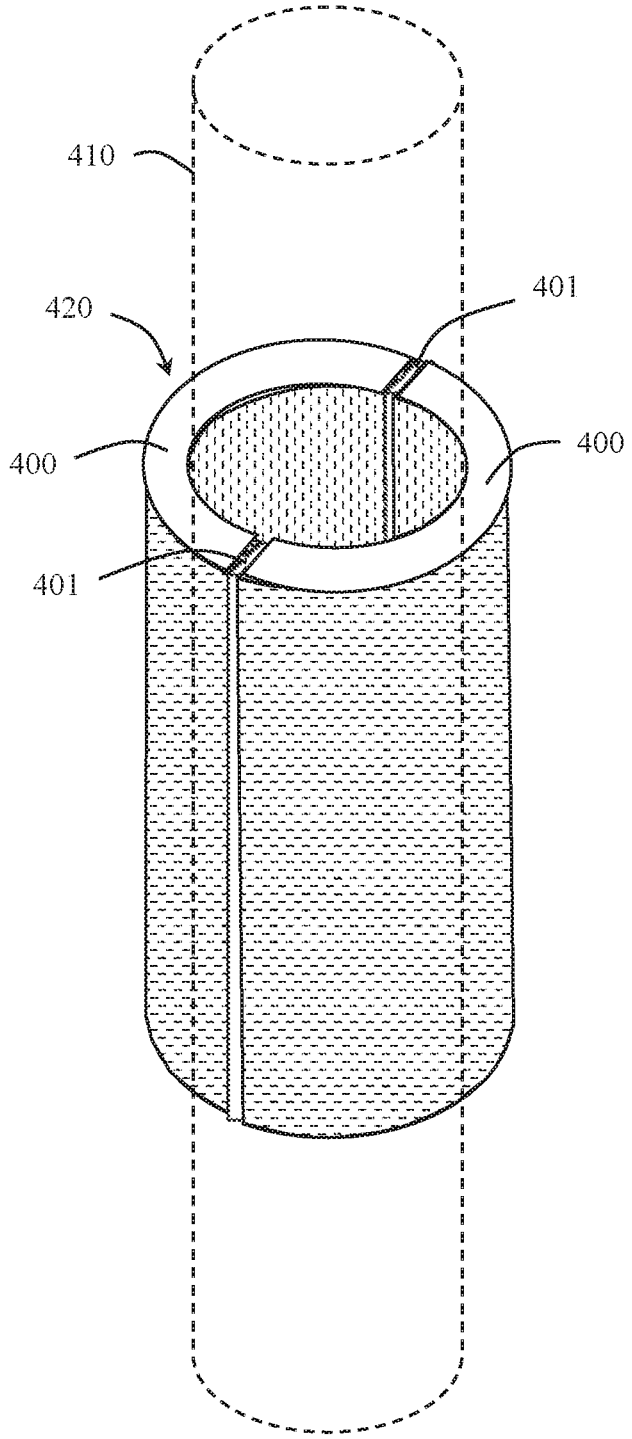
FIG. 10 shows the packed circumferential sections of FIG. 9 attached together around a liner according to embodiments of the present disclosure.

As shown in FIG. 10, when the packed circumferential sections 400 are attached together around a tubular (e.g., a perforated liner) 410, the packed filtration screen assembly 420 may extend entirely around the circumference of the tubular 410, divided by the radial walls 401 at equidistant circumferential locations. The packed circumferential sections 400 may be attached together and attached around the tubular 410, for example, by welding, clamps, or other attachment mechanism.

According to embodiments of the present disclosure, packed filtration screen assemblies may be used in well completion operations. For example, methods of completing a well may include attaching a packed filtration screen assembly around a perforated portion of a liner, sending the liner and attached packed filtration screen assembly into the well, and hanging the liner from an end of a casing lining the well, wherein the packed filtration screen assembly is positioned in an open hole portion of the well below the end of the casing. The packed filtration screen assembly around the perforated liner may filter sand or other fine solids such as silt from a poorly consolidated formation surrounding the liner from entering the liner. The packed filtration screen assembly may be packed with gravel or other filtration medium that is selected, for example, based on the type of formation in which the packed filtration screen assembly is used in. The gravel may be packed in the filtration screen assembly prior to bringing the packed filtration screen assembly to the well site, or at the well site.

Figure 11:
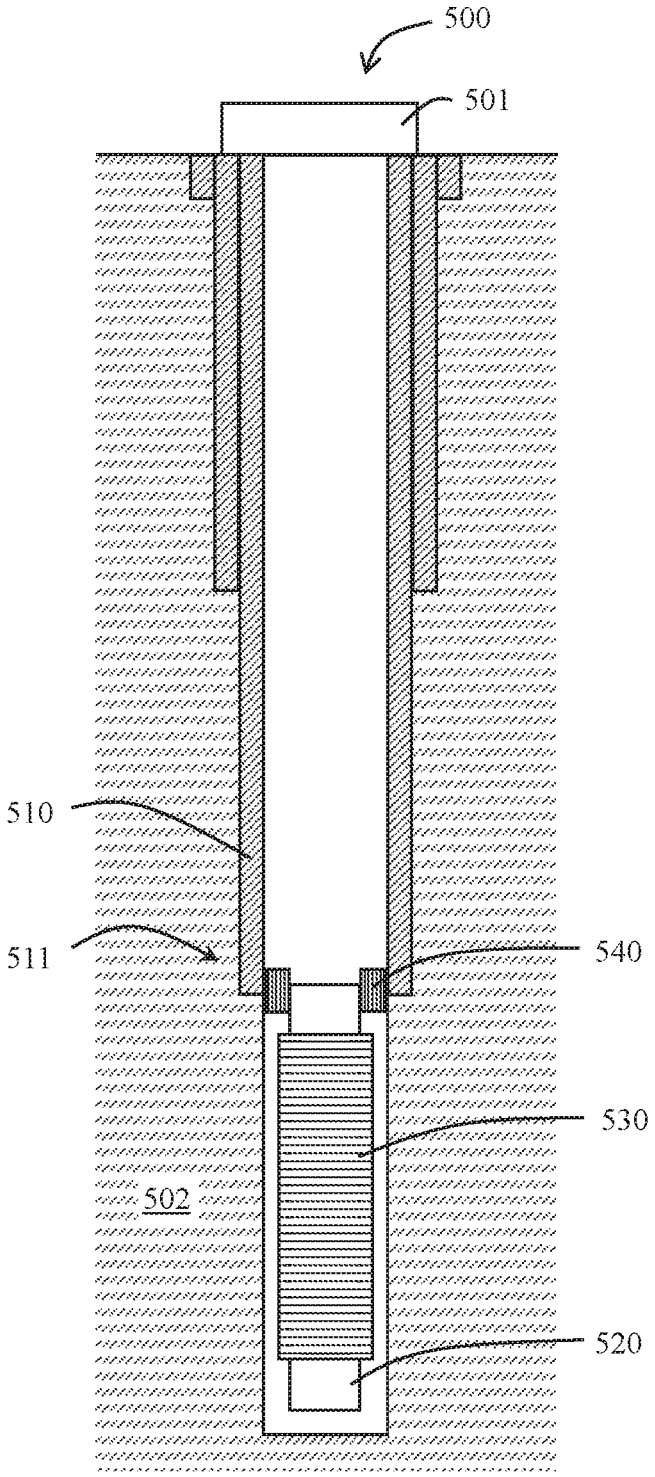
FIG. 11 shows a diagram of a packed filtration screen assembly in use in a well operation according to embodiments of the present disclosure.

For example, referring to FIG. 11 showing an example of a stage of a well 500 completion operation, one or more casings 510 may extend from a wellhead 501 to a depth in the well 500. The casings 510 may be set in the well 500, for example, by cementing the casings 510 in the well 500. A packed filtration screen assembly 530 according to embodiments of the present disclosure may be attached around a perforated portion of a liner 520 and sent downhole through the well casing 510. For example, the liner 520 may be sent downhole using a running tool.

The liner 520 may have a liner hanger 540 attached axially above the attached packed filtration screen assembly 530. The liner 520 may be sent into an open hole portion of the well 500, such that the liner 520 may extend from an end 511 of the casing 510 to a second depth in the well 500. The liner hanger 540 may be attached to the end 511 of the casing 510, thereby hanging the liner 520 from the end of the casing 510 and positioning the attached packed filtration screen assembly 530 within the open hole portion of the well 500. The attached packed filtration screen assembly 530 may filter fine solids that may flow from the formation 502 along with production fluids.

Once the packed filtration screen assembly 530 is positioned in the well 500 on the attached liner 520, an acid (e.g., hexa-meta-phosphate) may be pumped through the liner 520 to prepare and start enhancing the well 500 for production.

A pump may then be run downhole to pump fluids produced from the well 500 that flow from the open hole portion of the well 500, through the packed filtration screen assembly 530 and perforated portion of the liner 520 to the surface of the well 500.

According to embodiments of the present disclosure, a packed filtration screen assembly 530 may be returned to the surface of the well 500, for example, for repair, replacement, or when the production is complete. Methods of returning the packed filtration screen assembly 530 may include detaching the liner 520 from the casing 510, returning the liner 520 and attached packed filtration screen assembly 530 to the surface of the well 500 (e.g., using a running tool), and removing the packed filtration screen assembly 530 from the liner 520.

In some embodiments, after a packed filtration screen assembly 530 is removed from the liner 520, the packed filtration screen assembly 530 may be reused. For example, the used packed filtration screen assembly 530 may be attached around different tubular, such as a second perforated liner, or may be reattached to the perforated liner 520 and sent back downhole.

According to some embodiments, when a packed filtration screen assembly 530 is reused, the packed filtration screen assembly 530 may be at least partially disassembled, for example, to be repaired, to be cleaned, and/or have the filtration medium replaced. For example, in some embodiments, the filtration medium may be emptied from the packed filtration screen assembly 530 and replaced with a different type and/or size of filtration medium.

After a used packed filtration screen assembly 530 is reattached to a liner 520, the liner 520 and reattached packed filtration screen assembly 530 may be sent downhole, for example, in the same well 500 or in a different well for another completion operation.

In the embodiment shown in FIG. 11, the liner 520 and attached packed filtration screen assembly 530 may be installed in a vertical section of a well 500. However, packed filtration screen assemblies according to embodiments of the present disclosure may also be installed in directional wells, for example, in a horizontal section of a well.

By using packed filtration screen assemblies according to embodiments of the present disclosure, completion time may be minimized when compared to conventional methods of pumping gravel in and around perforated liners installed downhole. Further, by pre-packing filtration screen assemblies as disclosed herein, the appropriate amount of gravel or other filtration medium may be predetermined and used in a packed filtration screen assembly to assure successful filtration without plugging.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of completing a well, comprising:

packing gravel in an annular space between an inner slotted basket and an outer slotted basket to form a packed filtration screen assembly;

attaching the packed filtration screen assembly around a perforated portion of a liner;

sending the liner and attached packed filtration screen assembly into the well; and hanging the liner from an end of a casing lining the well, wherein the packed filtration screen assembly is positioned in an open hole portion of the well below the end of the casing.

2. The method of claim 1, further comprising:

detaching the liner from the casing;

returning the liner to a surface of the well; and removing the packed filtration screen assembly from the liner.

3. The method of claim 2, further comprising reusing the packed filtration screen assembly around a second liner.

4. The method of claim 2, further comprising:

reattaching the packed filtration screen assembly around the liner; and sending the liner and reattached packed filtration screen assembly downhole.

5. The method of claim 1, wherein attaching the packed filtration screen assembly comprises:

sliding the packed filtration screen assembly around the liner;

attaching a lower clamp around the liner at a lower axial end of the packed filtration screen assembly; and attaching an upper clamp around the liner at an upper axial end of the packed filtration screen assembly.

6. The method of claim 1, wherein attaching the packed filtration screen assembly comprises welding the packed filtration screen assembly to the liner.

7. The method of claim 1, wherein the inner slotted basket and the outer slotted basket are provided in multiple circumferential sections and the gravel is filled in the annular space in each of the multiple circumferential sections, wherein the multiple circumferential sections are fitted together around the liner to attach the packed filtration screen assembly to the liner.

8. The method of claim 1, further comprising pumping an acid through the liner to prepare the well for production.

9. The method of claim 1, further comprising running a pump downhole to pump fluids produced from the well to a surface of the well.

10. The method of claim 1, wherein the liner is installed in a horizontal section of the well.

11. The method of claim 1, wherein the liner is installed in a vertical section of the well.

12. A system for completing a well, comprising:

a casing extending from a wellhead to a depth in the well;

a liner attached to an end of the casing by a liner hanger, the liner extending from the end of the casing to a second depth in the well; and a packed filtration screen assembly disposed around a perforated portion of the liner, the packed filtration screen assembly comprising:

an inner slotted basket;

an outer slotted basket positioned concentrically around the inner slotted basket; and gravel held in an annular space between the inner slotted basket and the outer slotted basket and axial end caps located at opposite axial ends of the annular space;

wherein the packed filtration screen assembly is removably attached to the liner.

13. The system of claim 12, wherein packed filtration screen assembly is divided by radial walls into multiple circumferential sections attached around the perforated portion of the liner, each circumferential section comprising:

an inner slotted basket circumferential section; and an outer slotted basket circumferential section;

wherein the radial walls extend between the inner slotted basket circumferential section and the outer slotted basket circumferential section; and wherein the annular space between the inner slotted basket circumferential section, the outer slotted basket circumferential section, and the radial walls is filled with the gravel.

14. The system of claim 13, wherein the multiple circumferential sections are welded together and extend around an entire circumference of the liner.

15. The system of claim 12, wherein the packed filtration screen assembly is attached to the liner with a lower clamp attached around the liner at a lower axial end of the packed filtration screen assembly and an upper clamp attached around the liner at an upper axial end of the packed filtration screen assembly.

16. The system of claim 12, wherein the inner slotted basket and the outer slotted basket each comprise a plurality of slots having an opening width less than 0.05 inches.

17. The system of claim 12, wherein the perforated portion of the liner comprises perforation openings with a size greater than an opening width of slots formed through the inner slotted basket and the outer slotted basket.

18. The system of claim 12, wherein the gravel ranges in size from 1 mm to 2.5 mm in diameter.

19. The system of claim 12, wherein the annular space has a thickness measured between the inner slotted basket and the outer slotted basket that ranges from 0.5 inches to 4 inches.

* * * * *